United States Patent [19]

Richey

[11] Patent Number: 4,545,628

[45] Date of Patent: Oct. 8, 1985

[54] TOOL CHEST WITH RETRACTABLE STEP

[75] Inventor: Clyde D. Richey, Jamestown, N.Y.

[73] Assignee: The Jacobs Manufacturing Co., Tallmadge, Ohio

[21] Appl. No.: 581,119

[22] Filed: Feb. 17, 1984

[51] Int. Cl.[4] ..... A47B 83/04

[52] U.S. Cl. ..... 312/235 A; 182/17; 312/235 R

[58] Field of Search ..... 312/235 R, 235 A, 250; 248/617, 615; 5/507; 182/17, 88

[56] References Cited

U.S. PATENT DOCUMENTS

| | | | |
|---|---|---|---|
| 1,118,584 | 11/1914 | Roebuck | 182/88 |
| 2,495,374 | 1/1950 | Horn | 312/235 |
| 2,518,107 | 8/1950 | Wilson | 182/194 |
| 2,646,333 | 7/1953 | Abrahamson et al. | 312/348 |
| 3,756,678 | 9/1973 | Kloppenstein | 312/235 |
| 4,114,965 | 9/1978 | Oye et al. | 312/250 |

*Primary Examiner*—William E. Lyddane
*Assistant Examiner*—Joseph Falk
*Attorney, Agent, or Firm*—S. J. Rudy; C. L. Johnson

[57] ABSTRACT

A tool chest for mechanics tools which chest is movable on wheels and has a retractable step affording easy access to the topmost storage compartments when stepped upon by the tool chest user. The step is horizontally movable beneath the tool chest when not in use, and also is movable vertically so that it does not engage the floor when the tool chest is being moved.

7 Claims, 7 Drawing Figures

TOOL CHEST WITH RETRACTABLE STEP

BACKGROUND OF INVENTION

In the tool chest art of the type more commonly used by mechanics in auto repair shops, such chests have grown in size and storage capacity to accomodate the many specialized tools needed for work on more complicated vehicles, and accessory equipment. Such tool chests are often provided with wheels so that the chest can be easily moved into positions of convenience for the work being done.

With such tool chests of greater height it is often inconvenient for the mechanic to have easy access to the upper drawers or compartments. Such problems were sometimes handled by use of portable steps not directly affixed to the chests. The disadvantage of such an arrangement should be apparent.

It is a main object of this invention to provide a step attached to a tool chest which affords greater convenience to the mechanic when using the upper drawers or compartments of the tool chest.

Another object is to have the step vertically movable and arranged so that it is automatically out of contact with the floor supporting the tool chest when the chest is moved from one location to another.

These and further features and objects of the invention will become apparent from the following specification and accompanying drawings wherein.

Figure 1:
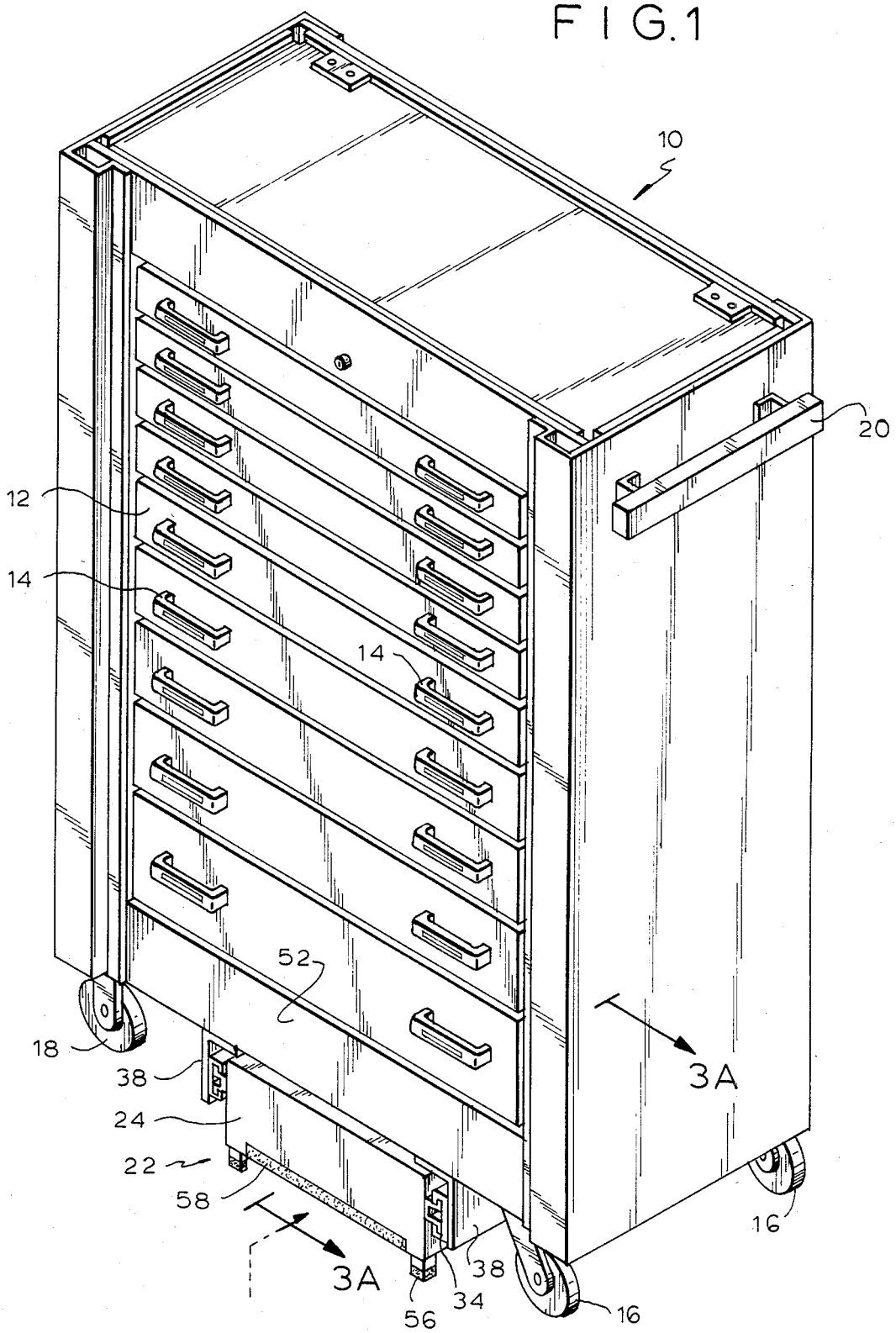
FIG. 1 is an isometric view of a tool chest having a movable step embodying the invention.
Figure 3B:
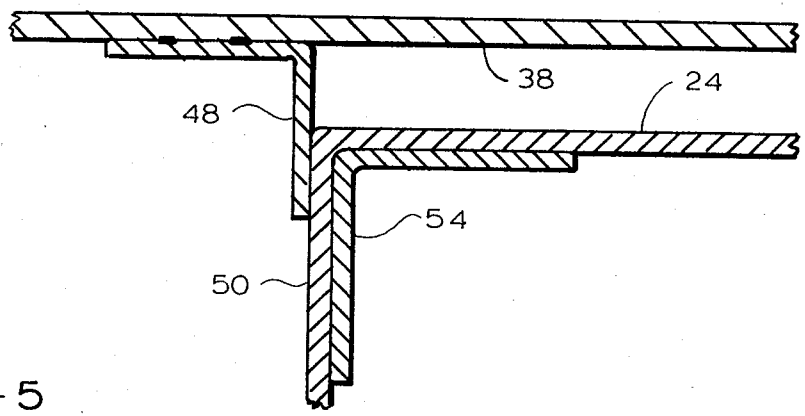
Figure 3A:
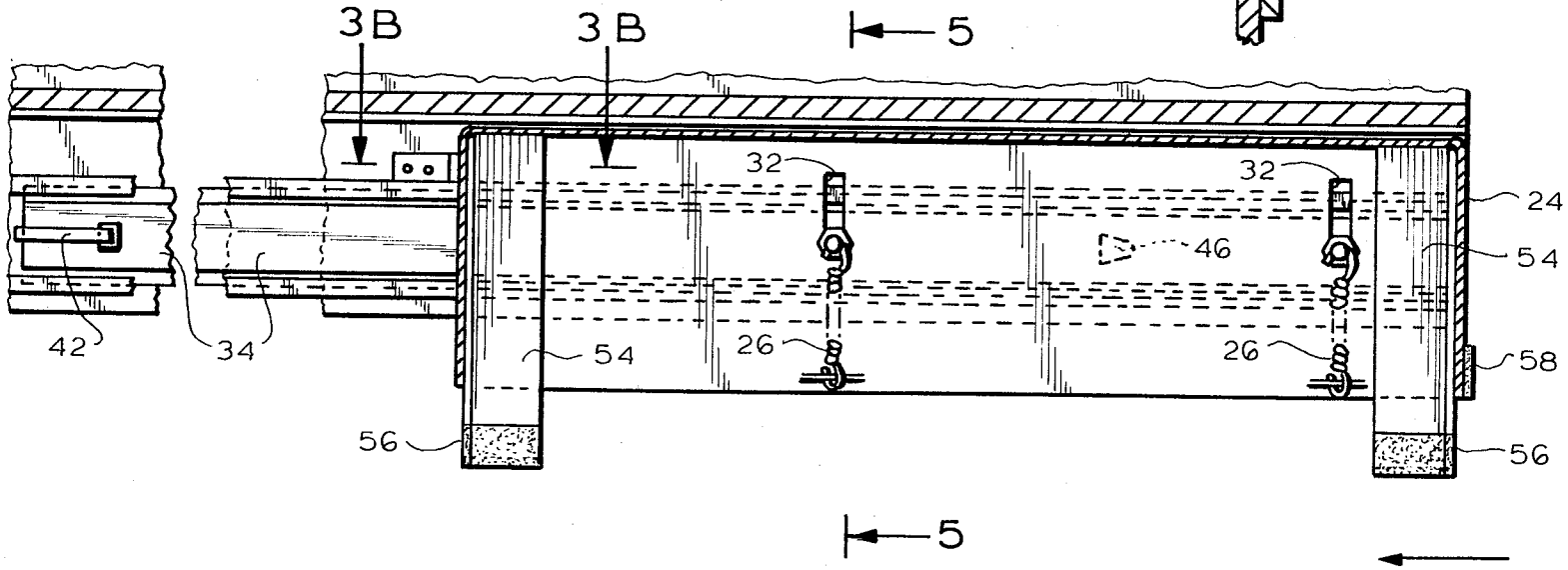

FIG. 3A a mid-section view of the step generally as seen from line 3A in FIG. 1;

FIG. 3B is an enlarged section view generally as seen from line 3B—3B FIG. 3A.

Figure 2:
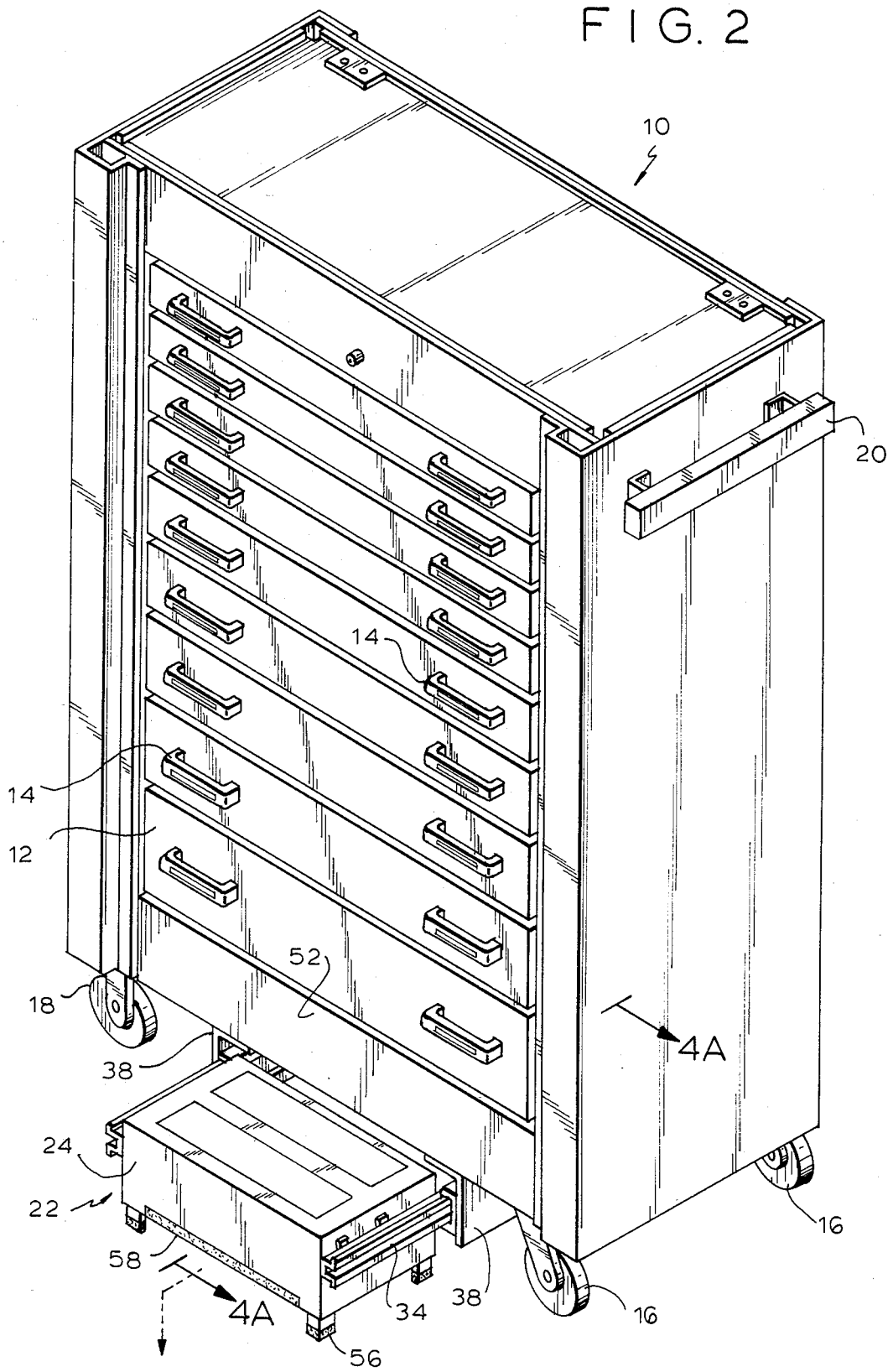
FIG. 2 is an isometric view of a tool chest having a movable step embodying the invention.
Figure 4B:
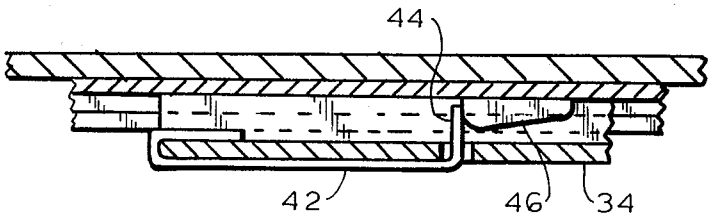
Figure 4A:
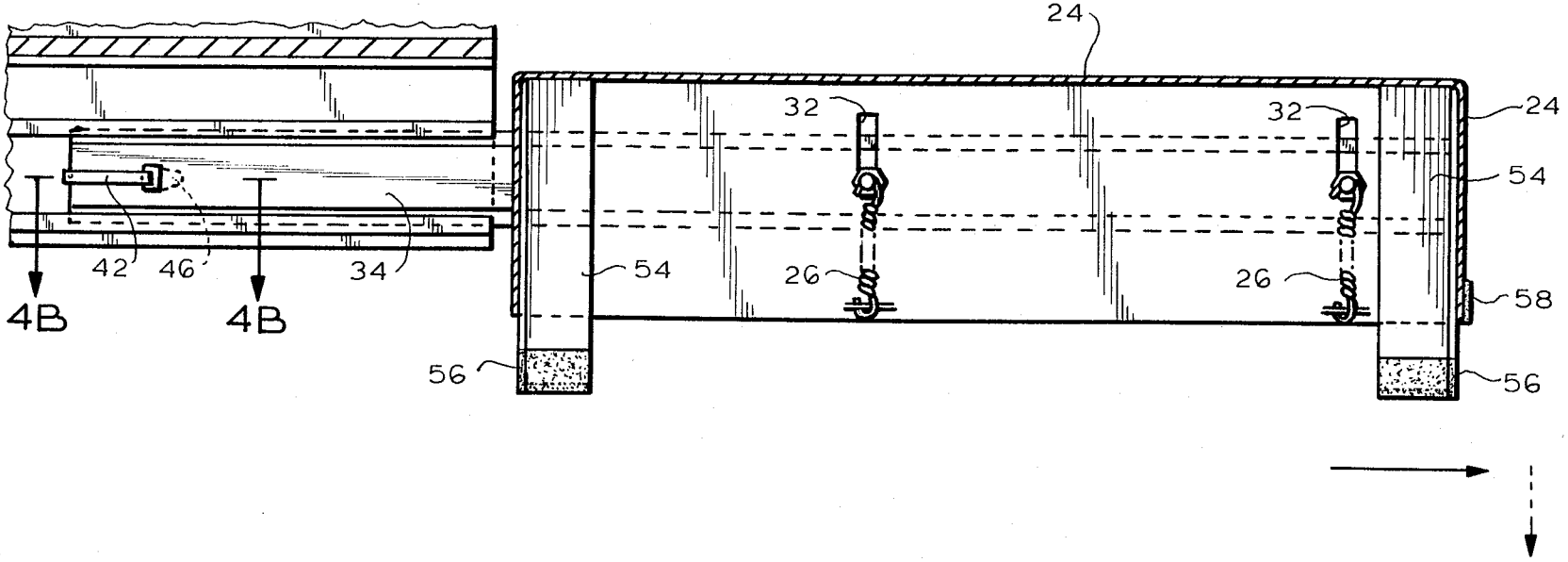
Figure 5:
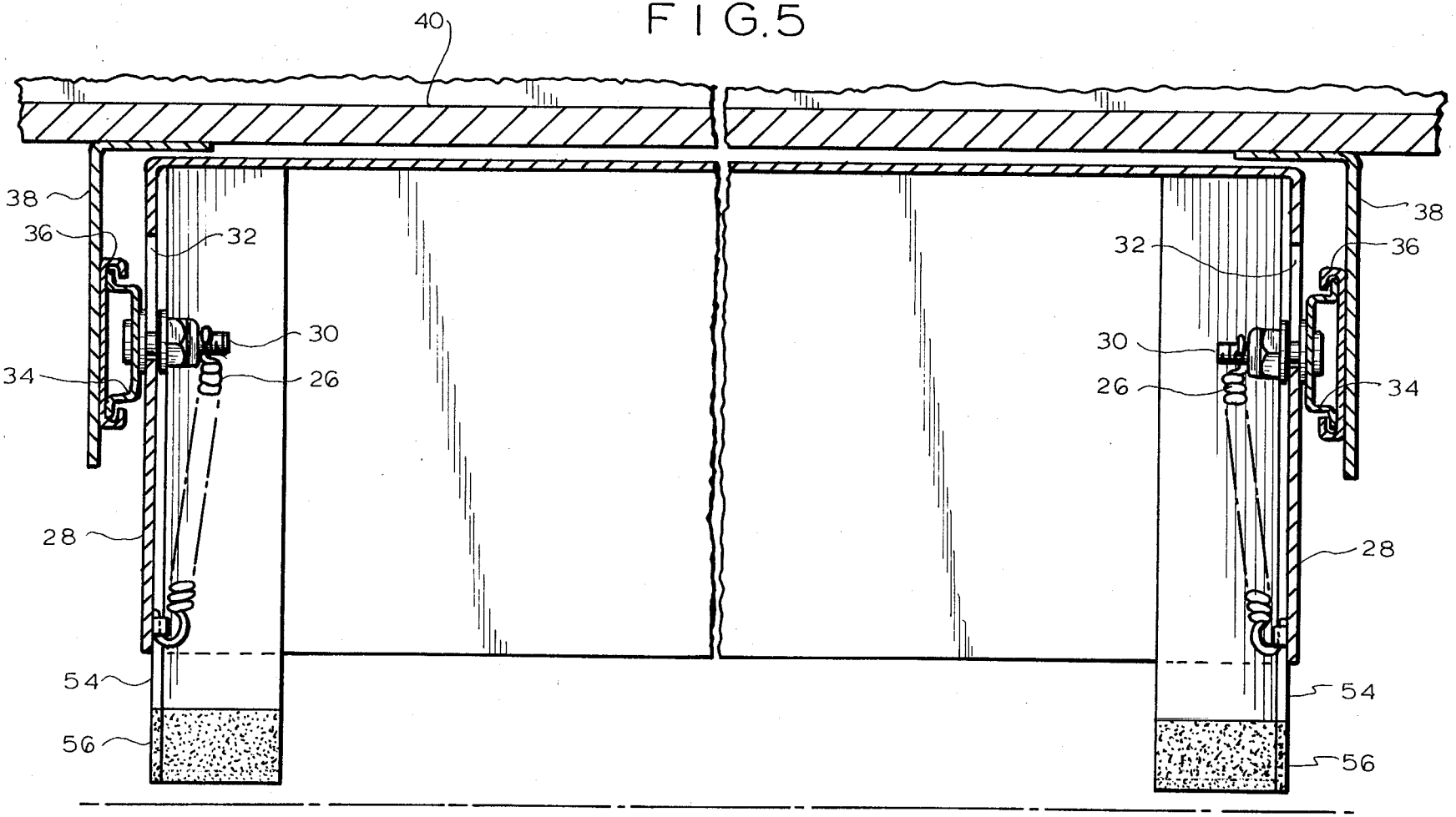

FIG. 4A a mid-section view of the step generally as seen from line 4A in FIG. 2;

FIG. 4B is an enlarged section view generally as seen from line 4B in FIG. 4A; and FIG. 5 is an enlarged section view generally as seen from line 5—5 in FIG. 3A.

Referring now to FIG. 1, numeral 10 identifies a tool box, or tool chest of the type on which the subject invention is used. The tool box has a plurality of drawers 12 having handles 14 for moving the drawer to closed or open position, the drawers preferably being of graduated size for accomodation of whatever tools are to be store therein. Two pairs of wheels 16 and 18 are provided for easy movement of the tool box, the wheels 16 being pivotally arranged for directional maneuverability of the tool box. A handle 20 is arranged on a side wall of the tool box, which the tool box user may grasp for movement of tool box. The tool box 10 is of a type well known in the art and no claims per se is made thereon.

Applicant's invention relates to a step assemblage 22 arranged beneath the tool box, FIG. 1 showing closed or non-use position and FIG. 2 showing opened or use position.

The assemblage 22 consists of a rectangular step 24 which is supported at each side as best seen in FIGS. 3A, 4A and 5, by a pair of coil springs 26, each affixed at a lower end to side walls 28 of the step portion and at an upper end to a bolt 30. Each bolt projects through a slot 32 formed in the side wall 28, and is affixed to a channel runner 34. As best seen in FIG. 5, the bolt 30 serves as an anchor for the spring 26 affixed thereto, the latter being arranged in tension so as to automatically lift the step portion upward toward the underside of the tool box.

Each channel runner 34 slides in a channel piece 36 affixed to an L-shaped hanger 38 secured to a bottom wall 40 of the tool box. It will be seen that such an arrangement allows for horizontal movement of the step 24 as well as vertical movement by reason of the bolts 30 projecting through the slot 32.

The outward movement of the step 24 is limited by runner clips 42 (FIG. 4B) which are affixed to each channel runner 34. Each clip has a right angle end 44 extending into the channel pieces 36 for abutment with an integral stop 46 provided in the channel piece 36. As best seen in FIG. 4A, the stop 46 is positioned to allow full outward movement of the step 24 before the clip end 44 abuts the stop 46.

Inward movement of the step 24 is limited by an abutment in the form of an L-shaped member 48 affixed to the hanger 38, which is abutted by a back wall 50 of the step 24, as best seen in FIG. 3B. The location of the abutment 24 is such as to have the front of the step 24 flush with a lower panel 52 extending the width of the tool box drawers (FIGS. 1 and 3A).

From the foregoing it will be seen that the subject invention represents a definite and unobvious improvement in the art to which it pertains.

What is claimed is:

1. In a tool chest for mechanics tools which chest is mounted on wheels to provide convenient mobility upon a floor, a step affixed to and retained beneath the bottom of the tool chest above the floor, means for moving said step horizontally from beneath the tool chest said step held by said tool chest by resilient means out of contact with the floor, said resilient means permitting vertical downward movement of the step, after the step is moved from beneath the tool chest, in response to a weight being placed upon the step, so that the step contacts the floor.

2. In a tool chest step according to claim 1, wherein a channel runner piece is affixed to each side of said step and a pair of channel pieces are secured to hanger pieces affixed to the bottom of the tool chest, which channel pieces provide slidable support for said channel runner pieces.

3. In a tool chest step according to claim 2, wherein said resilient means comprise coil springs the lower end of each being connected to the step and the upper end of each being connected to a bolt which extends through a slot formed in a side wall portion of the step and is affixed to a channel runner piece.

4. In a tool chest step according to claim 3, wherein a runner clip is affixed to each channel runner piece, which clip will engage a stop provided on the channel piece whereby the outward movement of the step from beneath the tool chest is limited.

5. In a tool chest step according to claim 4, wherein an abutment is affixed to each of the hanger pieces, which abutment is positioned to allow inward movement of the step underneath the tool chest a given amount.

6. In a tool chest step according to claim 5, wherein the step has a leg projecting downwardly from each corner, each leg having a resilient step cap affixed thereto.

7. In a tool chest step according to claim 5, wherein a resilient toe guard is arranged to extend along the front lower edge of the step between the front legs of the step.

* * * * *